United States Patent [19]

Stiefel et al.

[11] 4,164,990

[45] Aug. 21, 1979

[54] PASSENGER EVACUATION APPARATUS

[75] Inventors: Christian Stiefel, Aachen; Fritz Frederich, Krefeld, both of Fed. Rep. of Germany

[73] Assignee: Waggonfabrik Uerdingen Aktiengesellschaft, Krefeld, Fed. Rep. of Germany

[21] Appl. No.: 872,795

[22] Filed: Jan. 27, 1978

Related U.S. Application Data

[63] Continuation-in-part of Ser. No. 752,307, Dec. 30, 1976, abandoned.

[30] Foreign Application Priority Data

Dec. 23, 1975 [DE] Fed. Rep. of Germany ..... 2558225

[51] Int. Cl.[2] ..... A62B 1/20

[52] U.S. Cl. ..... 182/48; 104/122; 105/329 S; 182/76; 244/137 P; 244/DIG. 2

[58] Field of Search ..... 244/137 R, 137 P; 182/18, 19, 77, 81, 76, 70, 48, 82; 104/89, 106, 112, 122; 105/148, 329 S, 329 SC, 348

[56] References Cited

U.S. PATENT DOCUMENTS

| | | | |
|---|---|---|---|
| 318,299 | 5/1885 | Samper | 182/48 |
| 653,498 | 7/1900 | Barnett | 182/48 |
| 945,748 | 1/1910 | Butler et al. | 104/122 |
| 3,392,380 | 7/1968 | Fordyce | 182/18 X |
| 3,497,159 | 2/1970 | Lancsa | 182/48 |
| 3,768,593 | 10/1973 | Naka | 182/77 |
| 3,811,643 | 5/1974 | Pizzo | 244/137 P |
| 3,819,011 | 6/1974 | Kinase et al. | 182/48 |
| 3,977,495 | 8/1976 | Zephinie | 182/48 |
| 3,999,627 | 12/1976 | Naka | 182/19 X |

*Primary Examiner*—Galen L. Barefoot
*Attorney, Agent, or Firm*—Michael J. Striker

[57] ABSTRACT

An apparatus for evacuating passengers from a passenger-carrying cabin having a floor suspended above the ground comprises upper and lower plates engageable over the upper and lower sides of a vertical hole through the floor. These plates are both secured tightly in place on the respective sides of the floor in a normal position and are released in an emergency position, with the lower plate dropping away from the car. A tubular life-saving chute is secured to the floor between the sides in the hole and is folded up between the plates in the normal position, but extends from the floor toward the ground in the emergency position to allow persons to be saved to slide down through this chute. A linkage normally rigidly interconnects the two plates together, but is operated in case of fire or the like to disconnect them.

11 Claims, 5 Drawing Figures

PASSENGER EVACUATION APPARATUS

CROSS REFERENCE TO RELATED APPLICATION

This application is a continuation-in-part of copending application Ser. No. 752,307, filed Dec. 20, 1976 and now abandoned. It is also related to the commonly assigned patent application 605,248 filed Aug. 8, 1975, now abandoned, the entire disclosure of which is herewith incorporated by reference.

BACKGROUND OF THE INVENTION

The present invention relates to a passenger-evacuating device for use in connection with a passenger-carrying cabin. More particularly, this invention concerns such a device which is especially advantageously usable in a cable car, tramway, or the like wherein the floor of the passenger-carrying cabin is suspended above the ground.

In case of fire or similar emergency it is necessary to remove the passengers of the cable car, overhead tramway, elevator, or the like from the cabin which is often suspended a considerable distance above the ground. Under emergency conditions it is usually impossible to move the cabin, so that means must be provided allowing the passengers to be lowered to the ground.

It has been suggested to provide so-called life-saving bags in the cabin. Each passenger to be saved climbs into such a bag and is then lowered by means of a block-and-tackle arrangement to the ground. Such a device is relatively hard to use, requiring several people to lower the one person being saved. Furthermore such a life-saving system takes some time to set up so that in case of fire it is often almost totally unusable. Another disadvantage is that handicapped persons or the like are often injured during such a life-saving operation.

SUMMARY OF THE INVENTION

It is therefore an object of the present invention to provide an improved passenger evacuating apparatus of the kind under discussion.

Another object is the provision of such an apparatus that is usable in a cabin of a tramway, cable car, elevator, or the like for transporting passengers from the suspended cabin to the ground.

Yet another object is to provide such an apparatus which can be used rapidly and easily.

Yet another object is to provide an apparatus of this type which is unlikely to injure the user, and which does not require more than one person to operate.

These objects are attained according to the present invention in a life-saving device usable in a cabin having in its floor a vertically throughgoing hole of sufficient size to allow a person to fit down through the hole. The apparatus comprises an upper plate engageable with the upper side of the hole and a lower plate engageable with the lower side of the hole. Means is provided for securing both of these plates to the floor at the respective sides in a normal position and for releasing both of these plates from the floor in an emergency position for opening-up of the hole from both of its sides. A tubular life-saving chute is secured to the floor between the sides in the hole and is folded up between the plates in the normal position and is extensible down from the floor toward the ground in the emergency position.

According to further features of this invention this means includes a linkage which is spring-loaded into the emergency position, but which is held in the normal position so that the two plates are each held flush with the respective sides of the hole. The life-saving chute is of the type comprising two concentric tubes connected together at their upper end by means of a stitched-in securing ring. This ring or collar is secured inside the hole and is of a diameter sufficient to allow a person to fit through it. The inner tube serves to support the weight of the person sliding down through the tube and the outer tube elastically squeezes together the inner tube so as to slow down the person being saved as he or she slides down through the life-saving chute. Such a chute is described in catalog of company E.V.Z. FRANCE, having its principal place of business in Paris, France. Such description is herewith fully incorporated by reference.

Thus with the system according to the present invention in an emergency condition the upper and lower plates are released, so that the passengers inside the cabin can gain access to the life-saving chute in the cabin floor. Such persons need then merely climb into the chute and slide down through it to the ground. In case of an emergency such as fire which requires passengers to leave the cabin quickly it is possible for this apparatus to be used to excellent effect, as the set-up time is so short and operation is so simple that the entire group of passengers in a cabin can very quickly be conducted to safety.

According to further features of this invention the linkage that extends between the upper and lower plates and normally holds them together is operable by an electromagnet connected to a fire sensor in the cabin. It is also possible to operate this linkage directly through a port in the upper plate or elsewhere in the cabin. Such a port is covered with a glass or the like in the matter of a fire alarm so that if necessary the linkage can be operated manually.

In accordance with yet another feature of this invention an annular frame is fitted within the hole through the floor of the cabin and carries the chute as well as the upper and lower plates in the normal position. Thus a throughgoing hole in the cabin can simply be fitted with a single unit which comprises the entire life-saving apparatus. Therefore, it is possible very easily to replace the device and put the cabin back in service if desired.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
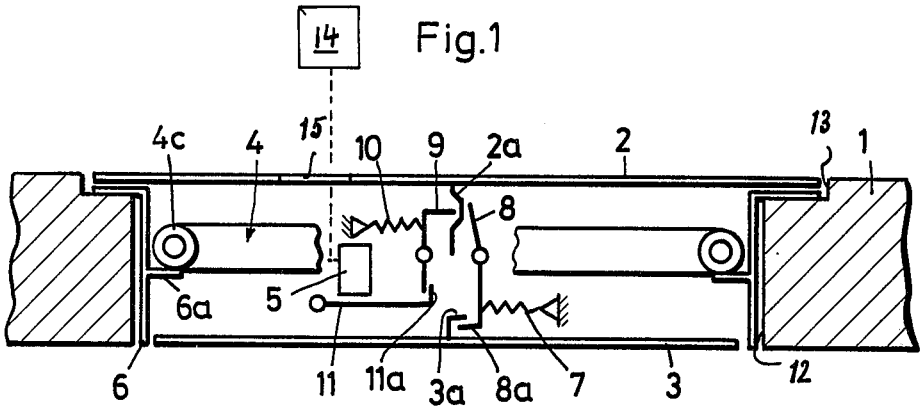
FIG. 1 is a vertical section through a cabin floor having the apparatus according to this invention.

The apparatus according to the present invention as shown in FIG. 1 is adapted to be fitted within a vertically throughgoing hole 12 formed in the floor 1 of the cabin of a tram car or the like as described in the above-cited copending patent application. This hole 12 is of circular shape and is fitted with an L-section frame 6. On top of this frame 6 an upper plate 2 of circular shape completely closes the top side of the hole 12, and another smaller circular plate 3 completely closes the bottom side of the hole 12 within the frame 6. The plate 2 overlaps the edges of the hole 12 and lies on top of a groove 13 formed at the edge of the hole 12 so that this plate 2 can readily support passengers who may therefore walk over it as if it were simply an integral part of the floor 1. The plate 3 is flush with the lower surface of the floor 1 much as the plate 2 is flush with the upper surface of the floor 1.

The frame 6 is formed with an inwardly extending flange 6*a* approximately equidistant between the plates 2 and 3 and supporting a life-saving chute 4 comprising an elastic outer tube 4*d*, a weight-supporting inner tube 4*e*, and a circularly annular collar 4*c* that rests on the flange 6*a*. This collar 4*c* is of a diameter sufficient to allow a person to pass through the collar 4*c*, and is rigid so that considerable weight can be supported by it.

A linkage interconnects the two plates 2 and 3 under normal circumstances. This linkage comprises a clip or receiver 2*a* carried on the upper plate 2 and another clip or receiver 3*a* carried on the lower plate 3. A lever 8 pivoted about a horizontal axis on a lug or flange of the upper plate 2 has a lower end 8*a* hooked under the clip 3*a*, so that when this end 8*a* is clipped under the end 3*a* the lower plate 3 hangs from the upper plate 2. A tension spring 7 is connected between the arm of the lever 8 carrying the bent-over end section 8*a* and a fixed support on the plate 2 so as normally to pull the end 8*a* away from the bent-over clip 3*a*. Another lever 9 which may be pivoted on a tab on the lower plate 3 normally engages the clip 2*a* and through it the upper arm of the lever 8. When in this position as shown in FIG. 1 it locks the upper plate 2 to the lower plate 3 and simultaneously holds the lever 8 in the indicated position to lock the plate 3 to the plate 2. Another tension spring 10 normally biases the lever 9 into a position away from the clip 2*a*. An electromagnet 5 between the two plates 2 and 3 holds another locking pawl 11 up against the force of gravity into a position holding the lever 9 in the illustrated position, that is with the plates 2 and 3 locked relatively together. Deenergization of this electromagnet 5 by means of a fire sensor 14 in the cabin above the floor 1 will cause the lever 11 to drop down and the lever 9 to pivot back from the clip 2*a*. It is now possible to open the upper plate 2, thereby causing the lever 8 to pivot back away from the clip 3*a* and normally allowing the plate 3 to fall away from the floor 1, namely to swing around a pivot axis of a hinge which interconnects the lower plate 3 and the frame 1 in an entirely conventional art. It is noted in this respect that the pivots for the levers 8, 9 and 11 may be provided on a separate unit independent of the two plates 2 and 3 and held between them. A window or access port 15 is provided in the upper plate 2 to allow for manual operation of the lever 11.

Figure 2:
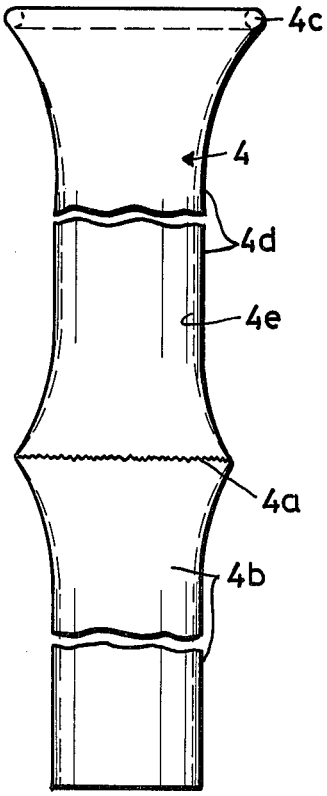
FIG. 2 is a side view of the life-saving chute in accordance with this invention.
Figure 3:
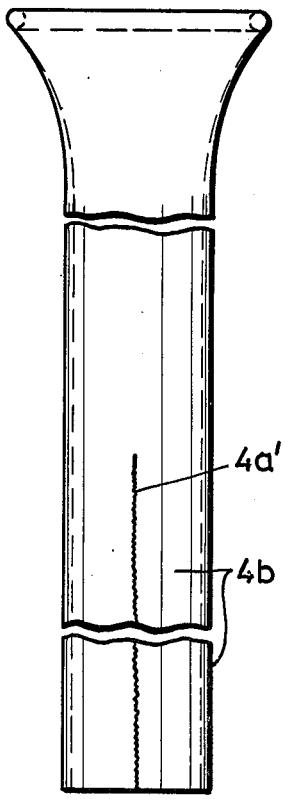
FIG. 3 is a side view similar to FIG. 1 illustrating another chute in accordance with this invention.

The life-saving chute 4 as shown in FIG. 2 may be formed at its lower end portion 4*b* with a circumferential zipper or slide fastener 4*a*. It is also possible as shown in FIG. 3 to provide an axially longitudinally extending slide fastener 4*a*'. The purpose of such fastener 4*a* and 4*a*' is to shorten the tube 4 so that it terminates somewhat above the ground in use, that is two or three feet. Thus the user can slide down through the chute 4, with the inner sleeve 4*e* radially supporting his or her weight and the outer sleeve 4*d* radially squeezing inwardly so as to brake the user's falling speed. A tube 4 is used having a length sufficient to reach all the way to the ground from the highest point at which the floor 1 will be suspended, and the fasteners 4*a* are provided so as to allow this tube to be shortened when in use, in order to allow the users to exit directly at the ground and not have to crawl along through a section of the tube lying on the ground.

Figure 4:
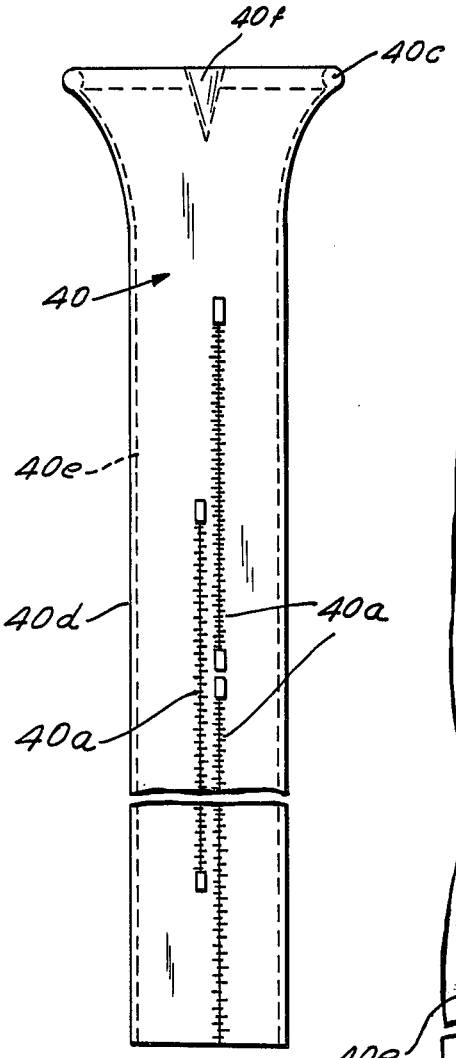
FIG. 4 is a view similar to FIG. 3, but showing a further embodiment of the invention.

FIG. 4 illustrates a passenger evacuation chute 40 resembling the one shown in FIG. 3. It has an annular collar 40*c*, an outer sleeve 40*d* and an inner sleeve 40*e* which correspond to the elements 4*c*, 4*d* and 4*e* of the preceding Figures, respectively.

The chute 40 also has a plurality of vertical openings which are closed by respective slide fasteners 40*a*. These openings, and the associated slide fasteners, are arranged at different levels along the length of the chute 40 and are so arranged as to vertically overlap (as shown) in order to create escape openings which can be used at different heights, i.e. irrespective of the distance between the ground and the floor of the cabin or other conveyance which is to be evacuated. Also, the vertical overlap of the slide fasteners 40*a* produces, in effect, an almost continuous escape opening over substantially the entire height of the chute 40. Yet, due to the fact that none of the slide fasteners 40*a* extend over the entire length, i.e. because there is not a single very long opening with a single very long slide fastener, the sliders of different fasteners are accessible at different levels and no one fastener need be slid over an inordinate length to create a full escape opening. This is an important consideration, especially in the event of panic.

In the area of the collar 70*c* the chute 40 is provided at its interior, at its side where the slide fasteners 40*a* are located, with a marker 40*f* in form of e.g. an arrowhead or a triangle. This may be a colored piece of cloth or the like that is sewn or otherwise secured to the material of the chute 40. The advantage of this arrangement is that when a passenger enters the upper end of the chute while facing the marker 40*f*, he or she will be directly facing the slide fasteners 40*a* after slipping to the ground or to the lower end of the chute 40. This facilitates the locating and operating of the slide fasteners 40*a* and thus reduces the escape time.

Figure 5:
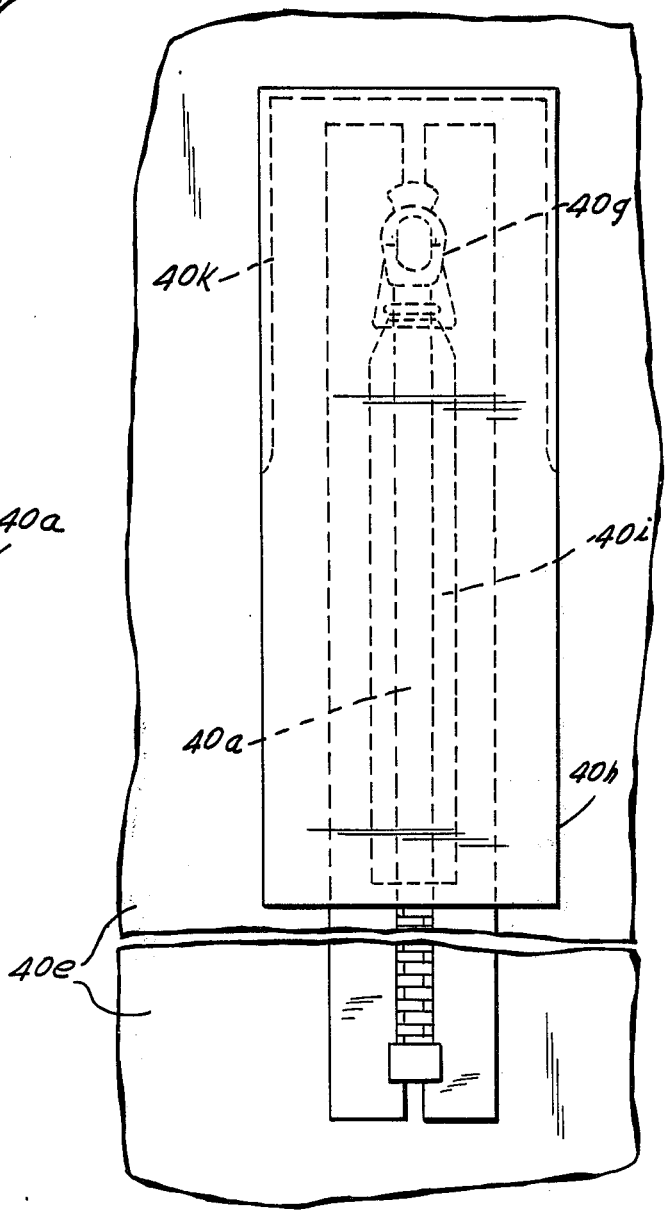
FIG. 5 is a fragmentary detail view of the interior of the device in FIG. 4.

One of the slide fasteners 40*a* is shown in FIG. 5 which is a view of the inner side of the chute 40. It will be noted that each slide fastener 40*a* (one shown) is covered at the interior of the chute 40 by a strip 40*h* of material, e.g. the same material as the sleeve 40*e*. The purpose of this is to keep the clothing of escaping passengers from becoming snagged on the slider 40*g* of the slide fastener and inadvertently operating the same. The strip 40*h* is connected (e.g. by sewing) to the chute 40 only in the vicinity of the slider 40*g*, normally along the seam or line 40*k*; below that seam it hangs free to provide ready access to the slide fastener. Another advantage of the strip 40*h* is that it relieves the slide fastener 40*a* of stresses resulting from the weight of a passenger in the chute 40. To facilitate the locating and subsequent operation of the slider 40*g*, the same may be provided with a hanging loop 40*i* of e.g. nylon webbing or any other suitable (but preferably flexible) material.

It will be understood that each of the elements described above, or two or more together, may also find a useful application in other types of structures differing from the types described above.

While the invention has been illustrated and described as embodied in a life-saving apparatus, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A passenger evacuation apparatus for use in a passenger-carrying cabin having a floor suspended above the ground, comprising an upper plate engageable with and normally overlying the upper side of a vertical hole through said floor and normally lying generally level with said upper side; a lower plate engageable with the lower side of said hole; securing means including a linkage in said hole connected between said plates and an electromagnet operatively connected to said linkage for securing both of said plates to said floor at the respective sides in a normal position and for releasing both of said plates from each other in an emergency position for opening-up said hole from both sides and for dropping-away of said lower plate; means in said cabin and connected to said electromagnet for detecting fire and operating said electromagnet to place said linkage in said emergency position on detection of fire; and a tubular life-saving chute secured to said floor between said sides in said hole and folded up between said plates in said normal position and extensible down from said floor in said emergency position, said chute having a lower end portion remote from said cabin in said emergency position and being provided at said lower end portion with at least one elongated exit port and slide-fastener means normally closing said port and being adapted to be opened so that when said lower end portion is on or near the ground below said cabin said exit port can be opened to permit exiting of a person from said chute.

2. The apparatus defined in claim 1; further comprising a frame fitting in said hole and carrying said plates in said normal position and also carrying said chute.

3. The apparatus defined in claim 1, wherein said upper plate lies flush with said upper side and said lower plate lies flush with said lower side in said normal position, whereby passengers in said cabin can walk on said upper plate.

4. The apparatus defined in claim 1, wherein said chute includes an outer elastic tube, an inner concentric weight-supporting tube, and an annular collar interconnecting said inner and outer tubes and secured to said floor between said sides, said collar being of a diameter sufficient to permit passage of a person therethrough.

5. The apparatus defined in claim 1, wherein said linkage includes a plurality of springs urging said linkage into said emergency position.

6. The apparatus defined in claim 1, said chute having at least one additional elongated exit port, both of said ports being elongated lengthwise of said chute and said additional exit port also being provided with slide-fastener means.

7. The apparatus defined in claim 6, wherein said exit ports partially overlap one another in the longitudinal direction of said chute.

8. The apparatus defined in claim 1, said slide fastener means comprising a slide fastener having a slider, and a gripping loop depending from said slider over at least a portion of the length of said exit port.

9. The apparatus defined in claim 1, said slide fastener means comprising a slide fastener including a slider thereof; and further comprising a strip of flexible material overlying said slide fastener at the interior of said chute and having an upper portion covering said slider and also a lower portion, only said upper portion of said strip being connected to said chute along seams which are spaced from said slider so that a person may have access to the slider by reaching beneath said strip.

10. The apparatus defined in claim 1, said chute having an upper open end and said exit port and slide fastener means being located at one side of said chute; and further comprising a marker at said upper end and at said one side so that a person entering said upper open end and facing said marker will be facing said exit port and slide fastener means upon arriving in said lower end portion of said chute.

11. The apparatus defined in claim 1, wherein said securing means comprises a pair of projections each extending from one of said plates into the space between said plates, said linkage including a pivoted arm on one of said plates and having a portion in retaining engagement with the projection of the other of said plates, biasing means permanently biasing said portion to move out of engagement with said projection of said other plate, and holding means movable between one position in which it counter-acts the force of said biasing means and another position in which it ceases to counter-act said force, said electromagnet acting upon said holding means for normally holding the same in said one position.

* * * * *